United States Patent [19]

Bostian, Jr.

[11] 4,353,509

[45] Oct. 12, 1982

[54] METHOD OF PREPARATION OF FIBERS AND FIBERS OBTAINED THEREFROM

[76] Inventor: Clarence L. Bostian, Jr., 153 W. 44th St., New York, N.Y. 10036

[21] Appl. No.: 258,439

[22] Filed: Apr. 28, 1981

[51] Int. Cl.[3] ..... B02C 19/12; B02C 23/08

[52] U.S. Cl. ..... 241/24; 241/28; 162/55; 162/99

[58] Field of Search ..... 209/2, 3, 4; 162/91, 162/99, 55; 241/4, 28, 9, 6, 24

[56] References Cited

U.S. PATENT DOCUMENTS

| | | | |
|---|---|---|---|
| 69,752 | 10/1886 | Bickfurd | 102/91 X |
| 308,398 | 11/1884 | Ammann | 162/99 X |
| 889,116 | 5/1908 | Gent | 209/4 |
| 1,236,072 | 8/1917 | Ellis | 162/99 X |
| 1,317,852 | 10/1919 | Arhenhurst | 241/4 |
| 2,520,483 | 8/1950 | Vanderjagt | 162/99 X |
| 2,813,626 | 11/1957 | Johnson | 241/4 X |
| 3,186,647 | 6/1965 | Basher | 241/4 |
| 3,346,110 | 10/1967 | LaFranca | 209/127 R X |

FOREIGN PATENT DOCUMENTS

| | | | |
|---|---|---|---|
| 8936 | of 1887 | United Kingdom | 162/99 |
| 121847 | 1/1919 | United Kingdom | 162/99 |

OTHER PUBLICATIONS

Inst. of Paper Chemistry, 21, No. 9, pp. 609, 610, May 1951.

Inst. of Paper Chem., 34, No. 2, 654, 655, Oct. 1963.

*Primary Examiner*—Ralph J. Hill

*Attorney, Agent, or Firm*—Toren, McGeady & Stanger

[57] ABSTRACT

A method for re-claiming fibers from peanut shells is disclosed wherein the shells are first flattened, the flattened shells are milled to produce a fraction containing fibers and a residue fraction and then the fiber fraction is separated from the residue. The fibers obtained are relatively long staple length fibers and can be used as an absorptive medium, in the form of continuous webs and the like.

9 Claims, 1 Drawing Figure

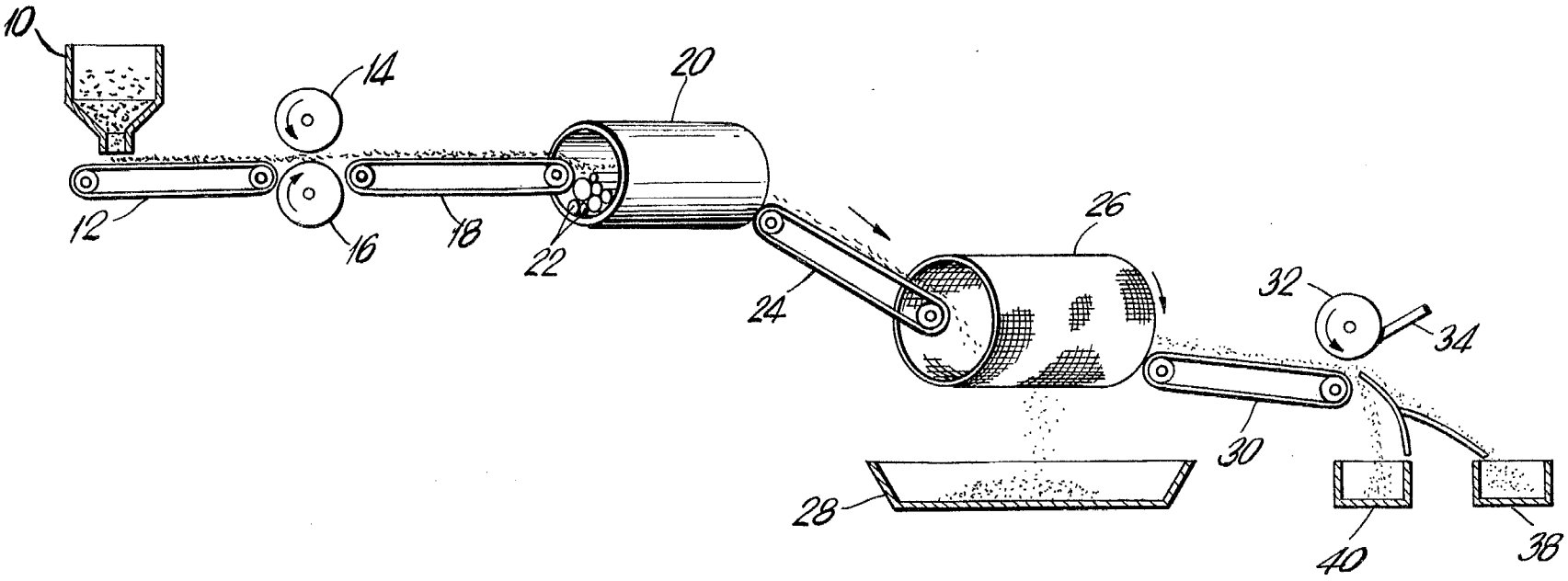
10
12
14
16
18
20
22
24
26
28
30
32
34
36
40

METHOD OF PREPARATION OF FIBERS AND FIBERS OBTAINED THEREFROM

BACKGROUND OF THE INVENTION

1. Field of the Invention

This invention relates to the field of reclaiming the fiber content from peanut shells and fibers obtained therefrom.

2. Description of the Prior Art

Peanuts constitute one of the major food crops in the United States and in certain other countries of the world. The shells from these peanuts amount to extremely large tonnage of waste material for which there is limited use at the present time. Thus, the shells resulting from the peanuts are suitable for use only as a cattle food extender, as fillers, and have little other commercial value and must be disposed of.

However, one of the problems with such disposal is that the peanut shells cannot be burned because of the toxic gases given off by their combustion. Consequently, the only method utilized for the disposal of peanut shells is burial or dumping. The discovery of a method for utilization of the peanut shells or components thereof, e.g., the fiber content, would thus represent a significant solution to the peanut shell disposal problem.

SUMMARY OF THE INVENTION

I have discovered a process for economically reclaiming the fiber content from peanut shells and rendering the thus obtained fibers suitable for commercial use. In particular, the end product obtained with the process of the present invention represent coarse fibers having a relatively long staple length which are situated in the outermost peripheral surface of the peanut shell. The shorter fibers which are located within the body of the shell and are akin to wood pulp fibers in size and which are thus less desirable are not isolated with the present process.

More particularly, the process of the present invention involves the step of first flattening the peanut shells from their generally round shape. Thereafter, the flattened shells are milled to produce a fiber fraction and a residue fraction. The residue fraction is composed of dirt, dust and shell particles. Finally, the fiber fraction which is composed of the above-noted relatively long staple length fibers are separated from the residue fraction.

The isolated fibers thus obtained are novel and can be processed to form an absorptive medium, e.g., in the form of batts for use in disposable diapers, for processing into a continuous web utilizing a vacuum cylinder, i.e., Rotoformer, or for an extender for wood pulp.

DESCRIPTION OF THE DRAWING

The drawing is a schematic diagram of a process in accordance with the present invention.

DESCRIPTION OF THE PREFERRED EMBODIMENTS

As shown in the drawing, the process of the present invention is carried out as follows. Empty peanut shells in hopper 10 are passed on to conveyor 12 and are subjected to a pre-crushing step wherein the shells are reduced from their generally rounded shape to a flattened configuration by passing through opposing rolls 14 and 16. This flattening step is carried out in order to reduce the dwell time of the material in the subsequent process steps. Rolls 14 and 16 turn in the direction indicated by the arrows and preferably are soft faced rolls. The gap between the rolls can vary depending on the degree of flattening required. This in turn depends on the type of peanut shell since the peanut shells vary in size from one species to another. Generally, the gap would be about three sixteenths of an inch.

The flattened shells are thus deposited onto conveyor 18 and fed into rod mill 20. While other types of milling devices, e.g., a ball mill, can be used, I have found that a rod mill produces the most advantageous separation.

Preferably, rod mill 20 contains rods 22 having different diameters. I have found that by varying the diameters of the rods, greater yields of fiber can be obtained. Preferably, the rods occupy from about 30 to 60 percent of the volume of the mill and the flattened shells occupy a volume from about 10 to 35 percent of the mill. Additionally, while mill 20 is shown in the drawing as being horizontal, it is possible to tilt the mill slightly in order to create a forward movement of the material through the mill onto conveyor 24. The product from the rod mill 20 is a material having essentially two fractions, namely, a fiber fraction consisting of the longer fibers from the shells and a residue fraction which contains dirt, dust and shell particles.

Conveyor 24 conveys this material into cylindrical screen 26 which rotates in the direction shown by the arrow. This results in separation of the fiber fraction which is retained in the screen from the residue fraction which falls into collector 28. Again, cylindrical screen 26 can be tilted somewhat resulting in a forward flow of the retained fibers onto conveyor 30. Conveyor 30 then passes the fibers with the shell particles in close proximity to roll 32 which carries an electrical charge thereon. The electrical charge attracts the fibers which cling to the roll and, as the roll revolves, the fibers are removed by utilizing an electrically non-conductive apron or scraper 34 which scrapes or peels the fibers onto baffle 36 from which they fall into collector 38. The shell particles, which are not attracted to roll 32, fall into collector 40. The fibers thus collected generally have a length in the range of from one-quarter to two inches and are ready for baling and subsequent processing.

The fibers thus produced can be used in a number of ways. For example, the fiber can be bleached in sodium hyperchlorite and used as an absorptive medium in batt form in, for example, a disposable diaper. Additionally, the fiber could be used for processing into a continuous web utilizing a vacuum cylinder (Rotoformer). A binder would be added to the resulting web and the product would have a variety of uses, such as, a secondary backing for carpet. Additionally, the fiber could be used as an extender for wood pulp after being mixed with wood chips and processed in a refiner or a Jordan engine.

The following example illustrates the present invention.

The Virginia peanut shells were first subjected to a light-precrushing by being fed on a rubber apron to two soft faced opposing rolls having a gap of about 3/16 of an inch between them.

Four dry quarts of Virginia peanut shells were placed in a cylindrical rod mill having interior dimensions of 10 inches by 18 inches. The mill was loaded with mild steel rods as follows:

3-2¼" × 18" rods, 22 lbs. each;

3-1 7/16"×18" rods, 14 lbs. each;

4-1"×18" rods, 9 lbs. each.

By using rods of different diameters, more complete milling is obtained than with rods of equal diameter. The rods occupied approximately 40 percent of the interior volume of the mill. The mill then rotated at approximately twenty revolutions per minute for twenty-five minutes to achieve de-fibering of the shell by separating the long fiber from the carcass of the shell. The mixture discharged from the milling was composed of fiber, shell particles of varying sizes, dust and dirt.

The discharge mixture was tumbled in a fine mesh screen covered cylinder to remove the dirt and dust content. The fiber was then separated from the other material by feeding a thin layer of the mixture on an apron or a continuous belt to an electrostatically charged zone so that the layer came into close proximity, i.e., ⅞" to 1" away, from a metal colored revolving cylinder located above the apron. The cylinder was charged with a positive electrical charge of 10,000 volts DC. Only the fiber portion of the mixture on the apron was attracted to the positively charged cylinder and as the cylinder rotated through part of a revolution, the fibers attracted thereto were removed by means of a non-conductive wiper blade and allowed to fall into a collector. The remaining portion of the material in the mixture was electrically non-conductive and passed out of the electrostatic zone on the apron into a collector. The fiber was not separated and could be baled.

While specific embodiments of the invention have been shown and described in detail to illustrate the application of the inventive principles, it will be understood that the invention may be embodied otherwise without departing from such principles.

What is claimed is:

1. A method for reclaiming fibers from peanut shells comprising:

(a) flattening the shells;

(b) milling the flattened shells to produce a fiber fraction, and a residue fraction containing dirt, dust and shell particles; and (c) separating the fiber fraction from the residue fraction.

2. The method of claim 1 wherein the separating is carried out by first screening the two fractions to separate the dirt and dust from the fiber of any shell particles and then passing this remaining mixture through an electrostatic zone to separate the fibers therefrom.

3. The method of claim 1 or 2 wherein the milling is carried out in a rod mill.

4. The method of claim 3 wherein the rods in the rod mill having different diameters.

5. The method of claim 1 or 2 wherein the flattening is carried out by passing the shells between opposing rolls.

6. The method of claims 1 or 2 wherein the separated fibers have a length in the range from about ¼ to 2".

7. The method of claim 3 wherein the rods occupy from about 30 to 60 percent of the volume of the mill.

8. THe method of claim 7 wherein the flattened shells occupy a volume from about 10 to 35 percent of the mill.

9. The process of claims 1 or 2 which further comprises processing the separated fibers into batts or a continuous web.

* * * * *